US010770242B2

(12) United States Patent
Ng et al.

(10) Patent No.: US 10,770,242 B2
(45) Date of Patent: Sep. 8, 2020

(54) BUTTON ASSEMBLY FOR A PORTABLE COMMUNICATION DEVICE

(71) Applicant: MOTOROLA SOLUTIONS, INC., Chicago, IL (US)

(72) Inventors: Chor Cheow Ng, Penang (MY); Chee Kit Chan, Ipoh Perak (MY); Cheah Chan Kee, Penang (MY); Sih Hau Tan, Selangor (MY)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 42 days.

(21) Appl. No.: 16/095,751

(22) PCT Filed: May 16, 2016

(86) PCT No.: PCT/MY2016/000028
§ 371 (c)(1),
(2) Date: Oct. 23, 2018

(87) PCT Pub. No.: WO2017/200372
PCT Pub. Date: Nov. 23, 2017

(65) Prior Publication Data

US 2020/0111625 A1 Apr. 9, 2020

(51) Int. Cl.
*H01H 13/14* (2006.01)
*H01H 13/705* (2006.01)
(Continued)

(52) U.S. Cl.
CPC ..... *H01H 13/14* (2013.01); *H01H 9/0214* (2013.01); *H01H 13/10* (2013.01);
(Continued)

(58) Field of Classification Search
CPC .... H01H 9/0214; H01H 13/14; H01H 13/705; H01H 13/08; H01H 13/48; H01H 2223/058
See application file for complete search history.

(56) References Cited

U.S. PATENT DOCUMENTS 4,972,051 A 11/1990 Hodsdon
5,746,307 A 5/1998 Joss et al.
(Continued)

FOREIGN PATENT DOCUMENTS

JP 3-130121 U 12/1991
JP 2009-135852 A 6/2009
(Continued)

OTHER PUBLICATIONS

PCT/MY2016/000028 International Search Report and Written Opinion of the International Searching Authority dated Oct. 20, 2016 (11 pages).
(Continued)

*Primary Examiner* — Vanessa Girardi
(74) *Attorney, Agent, or Firm* — Michael Best & Friedrich LLP

(57) ABSTRACT

A push-to-talk assembly includes a metal ring defining an interior aperture and including at least one exterior protrusion configured to couple the metal ring to a surface of the portable communication device. The push-to-talk assembly further includes a button coupled to the metal ring and including a flexible polymer material disposed within the interior aperture and co-molded to the metal ring. The button includes a first side configured to be contacted and pressed, and a second, opposite side configured to face an interior of the portable communication device. The push-to-talk assembly further includes a metal backing plate coupled to the second side of the button.

24 Claims, 15 Drawing Sheets

(51) Int. Cl.
*H01H 9/02* (2006.01)
*H01H 13/10* (2006.01)

(52) U.S. Cl.
CPC ..... *H01H 13/705* (2013.01); *H01H 2223/002* (2013.01); *H01H 2223/058* (2013.01)

(56) References Cited

U.S. PATENT DOCUMENTS

| | | | | |
|---|---|---|---|---|
| 8,124,902 | B2 * | 2/2012 | Watanabe | H01H 13/48 200/406 |
| 8,232,495 | B2 * | 7/2012 | Tang | H01H 13/52 200/516 |
| 9,142,367 | B2 * | 9/2015 | Dai | H01H 13/10 |
| 9,582,680 | B2 | 2/2017 | Bilodeau et al. | |
| 9,779,894 | B2 * | 10/2017 | Cohen | H01H 13/52 |
| 2006/0143459 | A1 | 6/2006 | Villaron et al. | |
| 2008/0026700 | A1 | 1/2008 | Smith | |
| 2009/0078553 | A1 | 3/2009 | Sanford et al. | |
| 2010/0330935 | A1 | 12/2010 | Maggert et al. | |
| 2011/0036696 | A1 | 2/2011 | Villain et al. | |
| 2011/0120849 | A1 * | 5/2011 | Morimoto | G06F 3/0338 200/5 A |
| 2012/0160640 | A1 | 6/2012 | Aldana et al. | |

FOREIGN PATENT DOCUMENTS

| | | |
|---|---|---|
| JP | 20090135055 | 6/2009 |
| JP | 2009-181893 A | 8/2009 |
| JP | 2002107806 | 12/2010 |
| JP | 2012134075 | 7/2012 |
| WO | 2013042403 A1 | 3/2013 |

OTHER PUBLICATIONS

Motorola Solutions, Inc., "Commercial Digital Two-Way Radio, MOTOTRBO SL Series SL300 Display Portable Radios," user guide, 53 pages, Schaumburg, US (2014) www.motorolasolutions.com/slseries.

Apple, "Hot sale replacement for Apple iPhone 5 Home Button Key with Metal Ring," image (Apr. 29, 2016) 1 page.

Japanese Office Actions dated Dec. 17, 2019 for corresponding Japanese Application No. 2018-558354 (4 Pages).

Office Action issued by the Japanese Patent Office for Application No. 2018-558354 dated Jul. 21, 2020 (8 pages including English translation).

* cited by examiner

BUTTON ASSEMBLY FOR A PORTABLE COMMUNICATION DEVICE

BACKGROUND OF THE INVENTION

Portable communication devices such as, for example, two-way radios, land mobile radios, hand-held telephones and the like often include push-to-talk assemblies. Push-to-talk is a means of communication commonly employed in wireless communication services that controls the switching between voice transmission and voice reception modes. These assemblies typically include buttons that when pressed allow a user to speak to another portable communication device.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
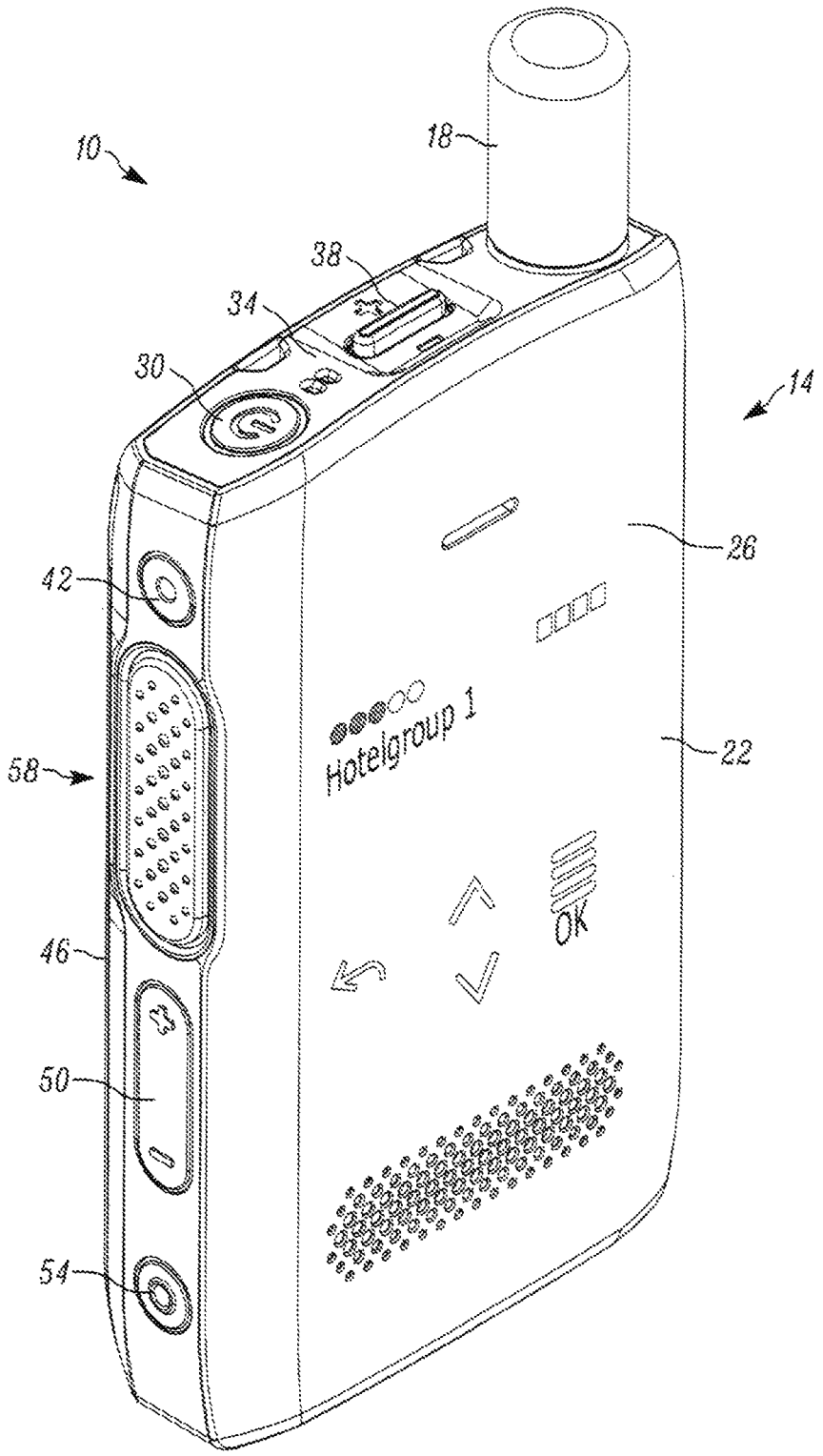
FIG. 1 is a perspective view of a portable communication device in accordance with one embodiment.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

A portable communication device includes a metal ring defining an interior aperture and including at least one exterior protrusion configured to couple the metal ring to a surface of the portable communication device. The push-to-talk assembly further includes a button coupled to the metal ring and including a flexible polymer material disposed within the interior aperture and co-molded to the metal ring. The button includes a first side configured to be contacted and pressed, and a second, opposite side configured to face an interior of the portable communication device. The push-to-talk assembly further includes a metal backing plate coupled to the second side of the button.

Figure 2:
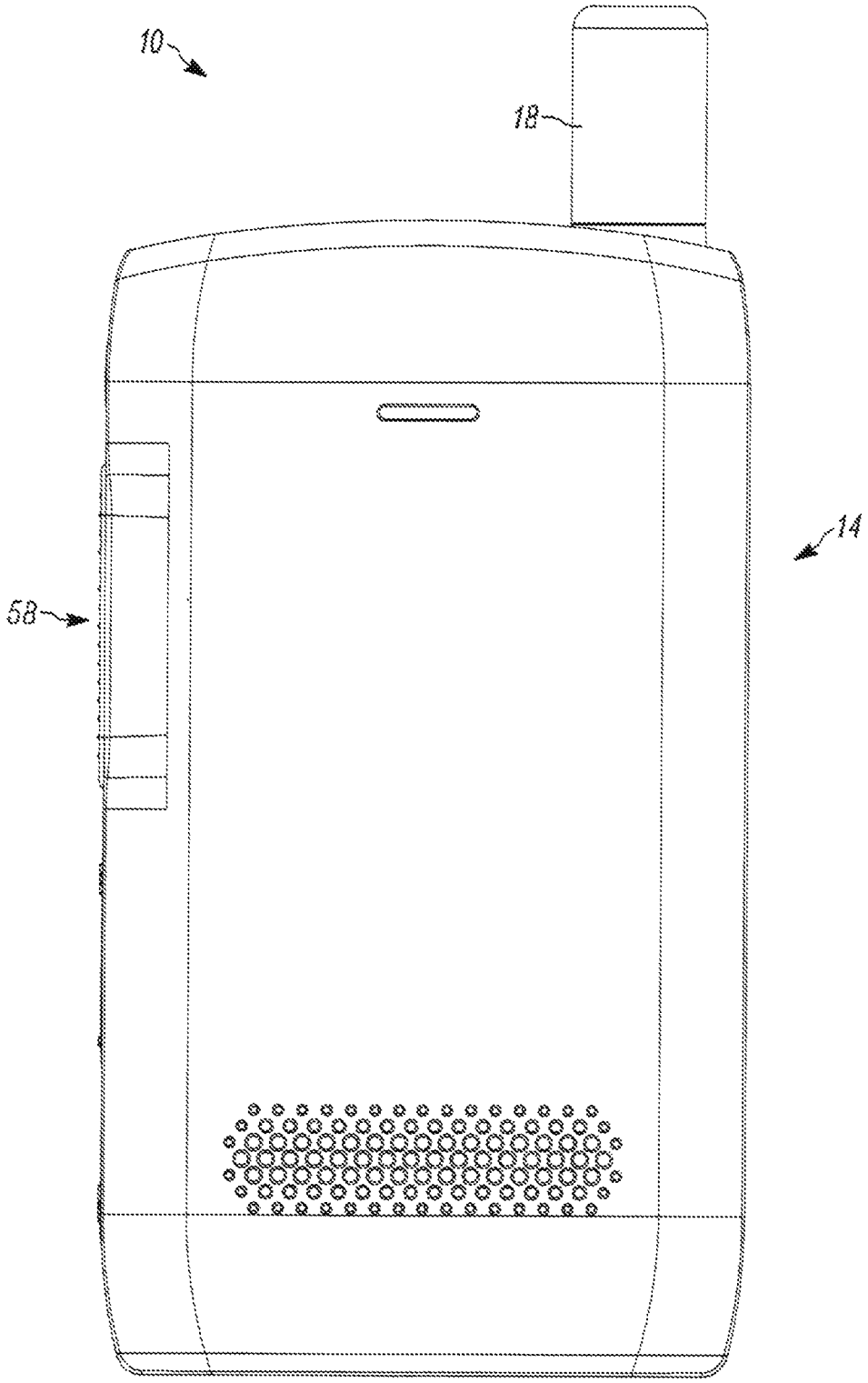
FIG. 2 is rear view of the portable communication device of FIG. 1.
Figure 3:
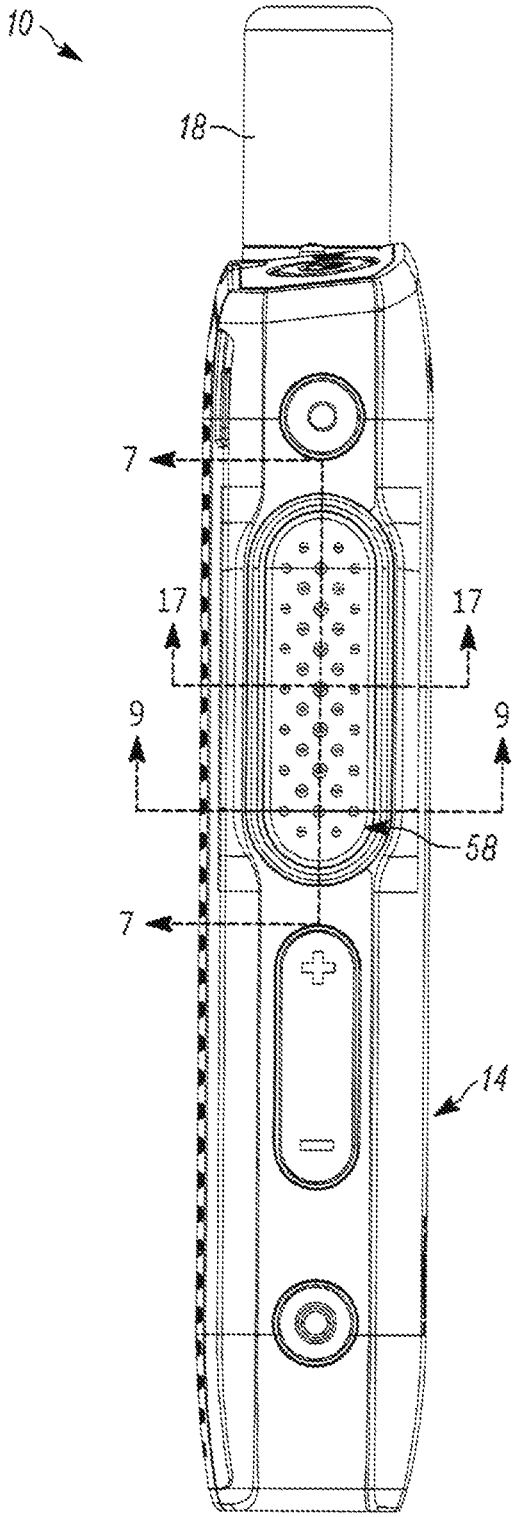
FIG. 3 is a side view of the portable communication device of FIG. 1.

FIGS. 1 through 3 illustrate one example of a portable communication device 10. In the example illustrated, the portable communication device 10 includes a housing 14. In some embodiments the housing 14 defines an enclosure of the portable communication device 10. The portable communication device 10 also includes an antenna 18 coupled to and extending from the housing 14, a display area 22 positioned on a front 26 of the housing 14, a power button 30 positioned along a top 34 of the housing 14, a toggle button 38 positioned along the top 34 of the housing 14, a first programmable button 42 positioned along a side 46 of the housing 14, a volume control button 50 positioned along the side 46 of the housing 14, a second programmable button 54 positioned along the side 46 of the housing 14, and a push-to-talk assembly 58 positioned along the side 46 of the housing 14. Other embodiments include different locations for the antenna 18, the display area 22, the power button 30, the toggle button 38, the first and second programmable buttons 42, 54, and/or the push-to-talk assembly 58 other than that illustrated. In some embodiments one or more of the antenna 18, the display area 22, the power button 30, the toggle button 38, and the programmable buttons 42, 54 are not provided.

Figure 4:
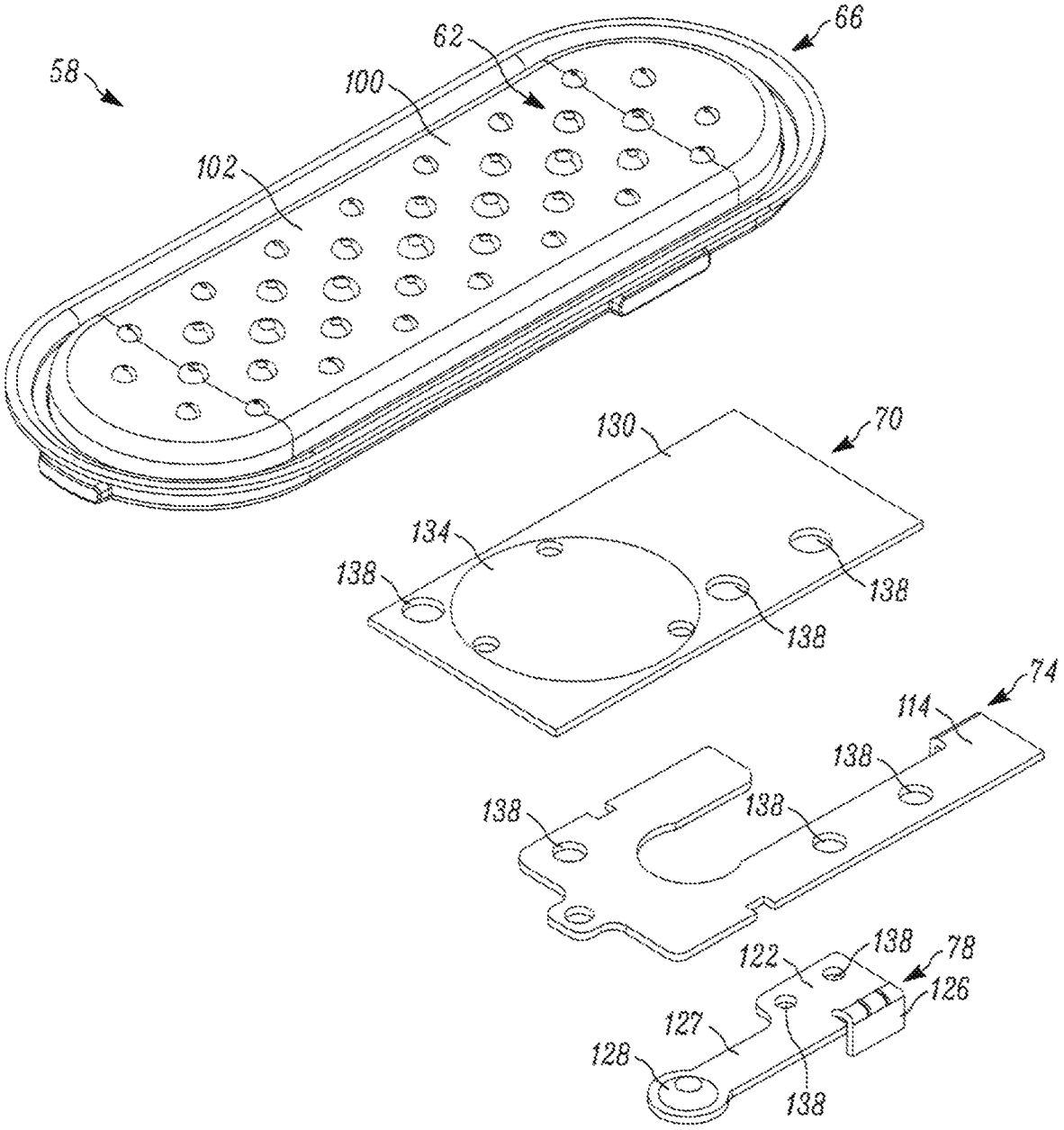
FIG. 4 is a perspective, exploded view of a push-to-talk assembly of the portable communication device of FIG. 1.

With reference to FIG. 4, the push-to-talk assembly 58 includes a button 62, a metal ring 66 coupled to the button 62, a dome array assembly 70, a ground metal plate 74, and a reinforcement metal plate 78. As illustrated in FIGS. 1 and 2, once assembled the push-to-talk assembly 58 is positioned along the side 46 of the housing 14 such that the push-to-talk assembly 58 is generally flush with the side 46 of the housing 14, and does not protrude from the housing 14.

Figure 5:
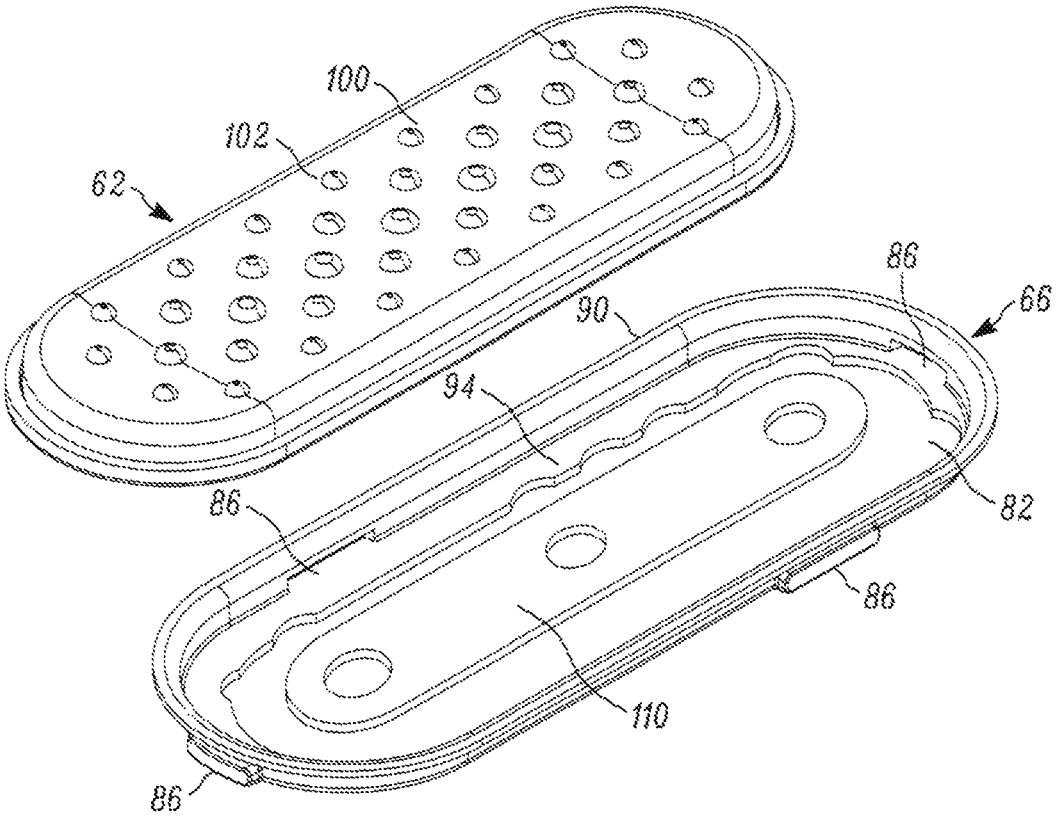
FIG. 5 is a perspective, exploded view of a button and metal ring of the push-to-talk assembly.

With reference to FIG. 5, the metal ring 66 defines an interior aperture 82, and includes at least one exterior protrusion 86 configured to couple the metal ring 66 to a surface of the portable communication device 10. In the illustrated embodiment, the metal ring 66 includes four exterior protrusions 86, each forming an undercut that acts as a catch element to engage a portion of the housing 14. Other embodiments include different numbers of exterior protrusions 86, or other structures that are configured to couple the metal ring 66 to a surface of the portable communication device 10. As illustrated in FIG. 5, the metal ring 66 has a generally elongate shape with rounded ends, and includes a main ring portion 90 and a ledge 94 that extends from the main ring portion 90 inwardly toward the interior aperture 82. In the illustrated embodiment the metal ring 66 is made of stainless steel sheet metal. Other embodiments of the metal ring 66 include different shapes and sizes than those illustrated, as well as different materials.

Figure 6:
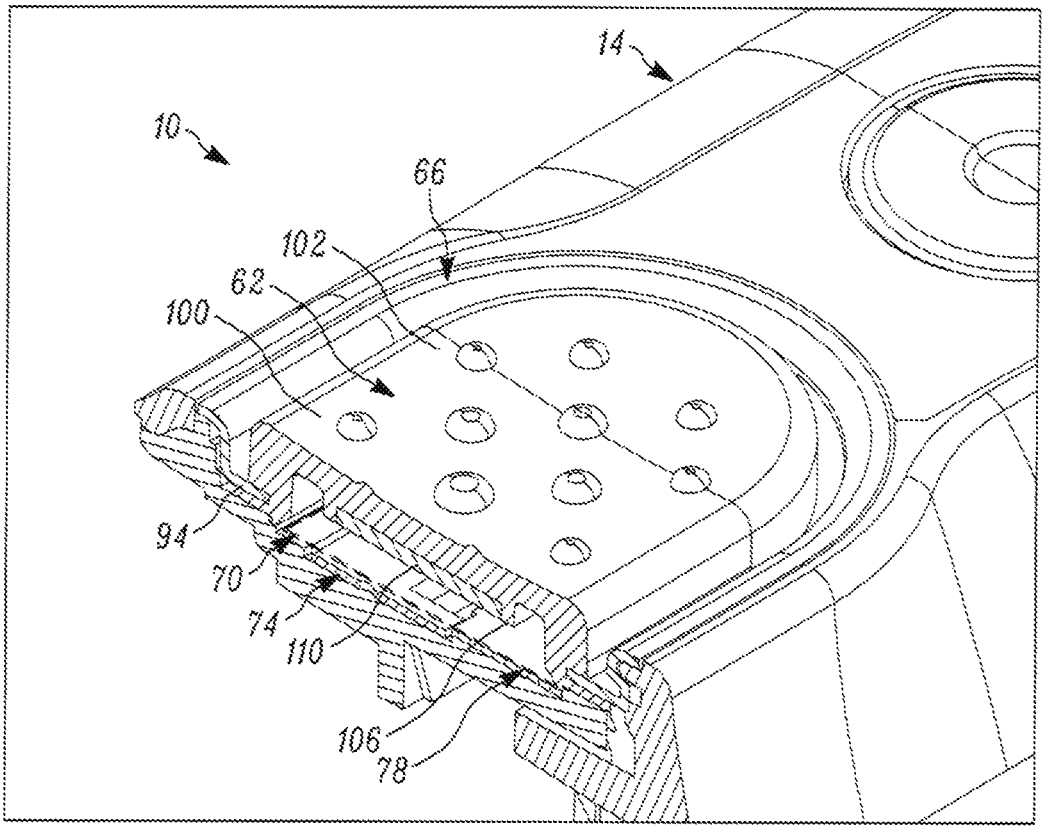
FIG. 6 is a perspective, cross-sectional view of the portable communication device of FIG. 1, illustrating the push-to-talk assembly in an assembled state.
Figure 7:
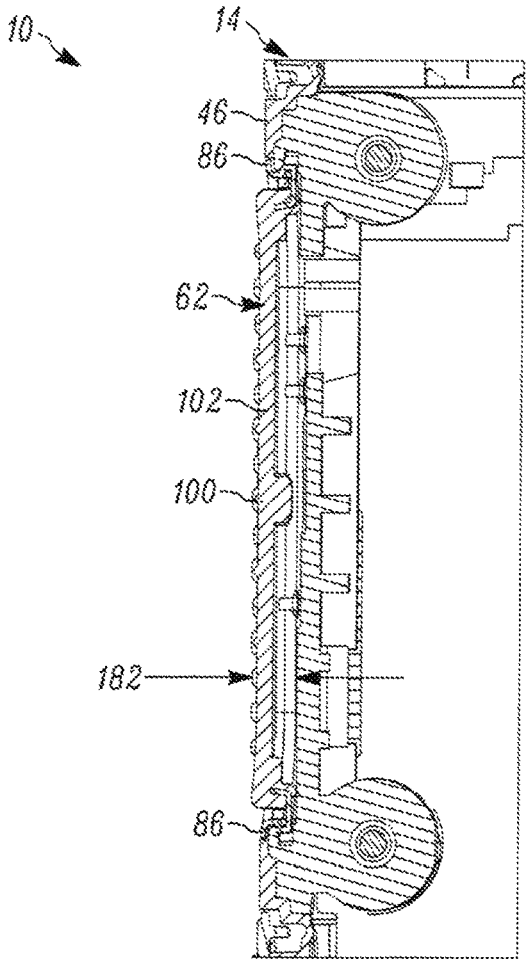
FIG. 7 is a cross-sectional view of the portable communication device of FIG. 1, taken along lines 7-7 in FIG. 3.
Figure 8:
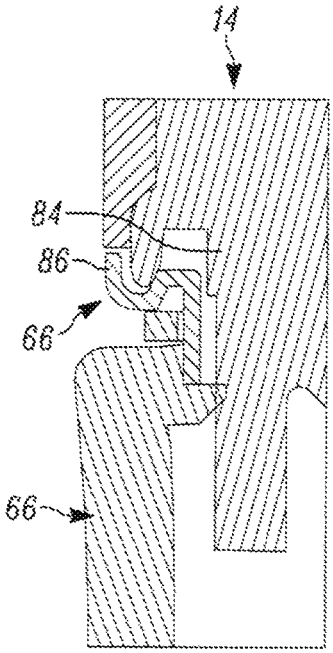
FIG. 8 is an enlarged portion of the cross-sectional view of FIG. 7, illustrating a catch element on the metal ring of the push-to-talk assembly.
Figure 9:
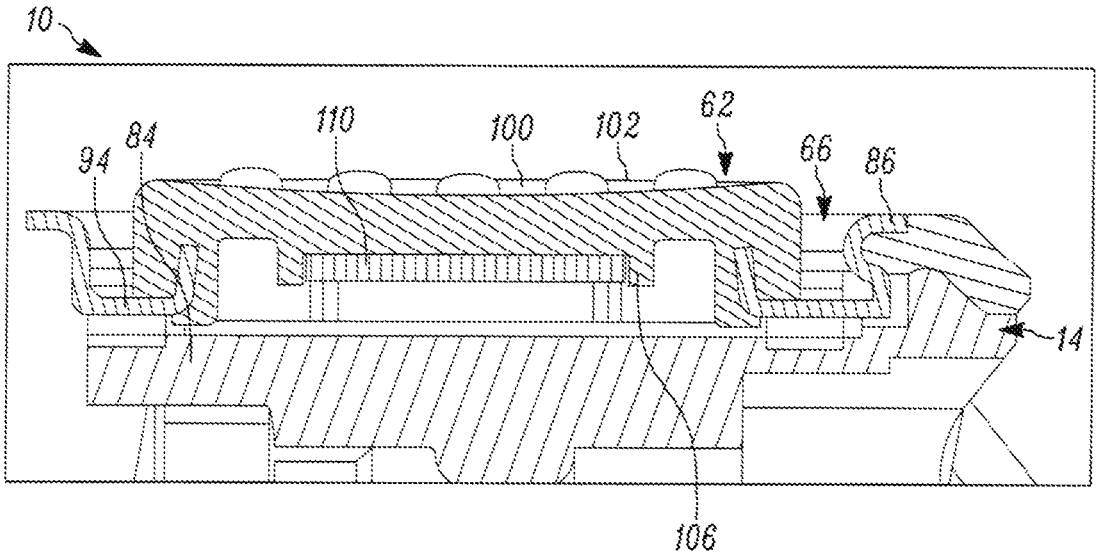
FIG. 9 is a cross-sectional view of the portable communication device of FIG. 1, taken along lines 9-9 in FIG. 3, illustrating a catch element on the metal ring of the push-to-talk assembly.

With reference to FIGS. 6 through 9, when the button 62 and metal ring 66 are assembled on the housing 14, the metal ring 66 generally sits into a recessed area 84 (FIG. 8) of the housing 14, such that an outermost portion of the metal ring 66 is flush or generally flush with an outermost portion of the housing 14, and such that the exterior protrusions 86 grip onto one or more areas of the housing 14. As illustrated in FIGS. 7 through 9, in the illustrated embodiment the metal ring 66 includes an exterior protrusion 86 along a top of the metal ring 66 and another exterior protrusion 86 along a bottom of the metal ring 66 (as seen in FIG. 7), as well as an exterior protrusion 86 along each side of the metal ring 66 (as seen FIG. 9, with only one of the exterior protrusions 86 visible in FIG. 9 due to the offset nature of the exterior protrusions 86 illustrated in FIG. 5). As illustrated in FIG. 8, each of the exterior protrusions 86 has a bent, or C-shaped profile that allows the exterior protrusion 86 to act as a catch element that engages the housing 14 and couples the metal ring 66 and the button 62 to the housing 14 (for example in a snap-fit manner). The metal ring 66, including its exterior protrusions 86, provide stability to the overall push-to-talk assembly 58, and strengthen the housing 14 in the region of the recessed area 84. Other embodiments include different shapes and sizes for the exterior protrusions 86, as well as different locations for the exterior protrusions 86 than that illustrated. Other embodiments also include different locations along the portable communication device 10 for the metal ring 66 and the button 62 than that illustrated.

With reference to FIGS. 5 and 6, the button 62 is made of a flexible polymer material (e.g., silicone rubber) and includes a collapsible region 100. The button 62 is disposed within the interior aperture 82, and is co-molded to the metal ring 66, such that portions of the button 62 wrap around and/or otherwise engage the ledge 94 (as seen in FIG. 6). Other embodiments of the button 62 are made of different materials, or are coupled to the metal ring 66 in a different manner (for example via an adhesive).

With continued reference to FIG. 6, the button 62 includes a first side 102 and a second, opposite side 106. The first side 102 is configured to be contacted and pressed by a user, in the collapsible region 100. The second side 106 faces an interior of the portable communication device 10.

With reference to FIGS. 5 and 6, the push-to-talk assembly 58 also includes a metal backing plate 110. The metal backing plate 110 is coupled to the second side 106 of the button 62. The metal backing plate 110 provides added stability behind the button 62, such that when a user presses on the first side 102, the force is distributed across generally the entire button 62. Thus, even if the user fails to press the button 62 in a center of the button 62, the push-to-talk assembly 58 is still activated.

In the illustrated embodiment the metal backing plate 110 is adhesively bonded to the second side 106 of the button 62. In other embodiments the metal backing plate 110 is co-molded with the button 62, or is coupled to the second side 106 in another manner. As illustrated in FIG. 5, the illustrated metal backing plate 110 is a generally elongate plate with rounded ends. However, other embodiments include different shapes and sizes than that shown.

Figure 10:
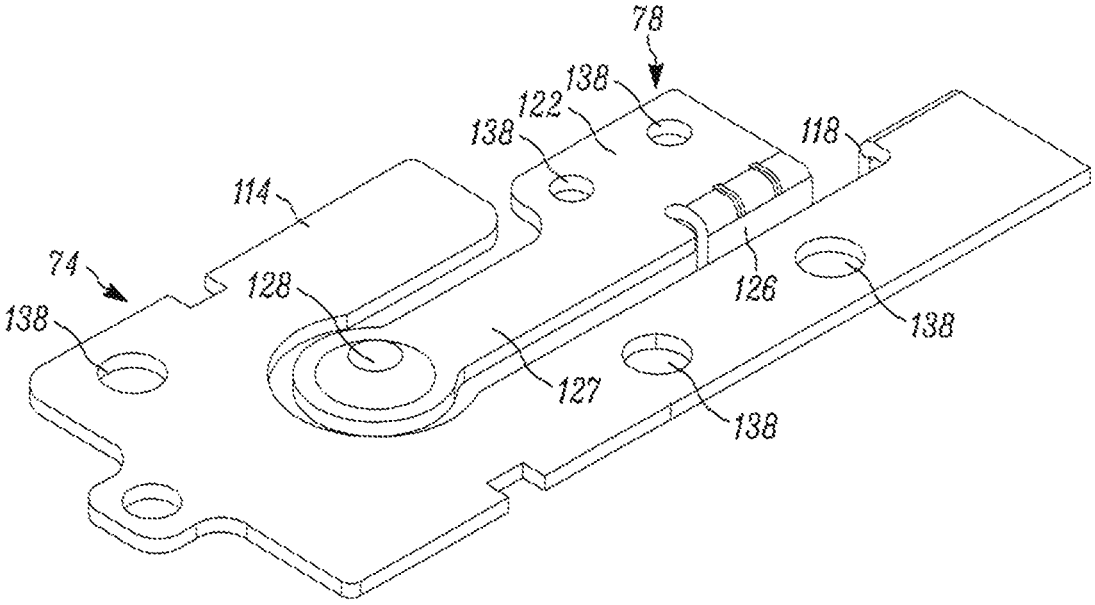
FIG. 10 is a perspective, exploded view of a ground metal plate and reinforcement metal plate of the push-to-talk assembly.

With reference to FIG. 10, the ground metal plate 74 includes a first planar body portion 114 and a first tab 118 that extends at a non-zero angle (for example 90 degrees) from the first planar body portion 114. The reinforcement metal plate 78 includes a second planar body portion 122 and a second tab 126 that extends at a non-zero angle (for example ninety degrees) from the second planar body portion 122. The reinforcement metal plate 78 further includes a rigid, stationary terminal 127 having a free end 128 that defines a hard contact area. The free end 128 is disposed at an opposite end of the reinforcement metal plate 78 from the second tab 126. As illustrated in FIG. 10, in an assembled state the ground metal plate 74 is spaced at all points from the reinforcement metal plate 78, and the first and second tabs 118, 126 are positioned adjacent one another.

In the illustrated embodiment both the ground metal plate 74 and the reinforcement metal plate 78 are made of titanium copper alloy sheet metal, plated with gold. In other embodiments the ground metal plate 74 and the reinforcement metal plate 78 are made of different materials and/or have different types of plating, including nickel plating, or any other electrical conductor material with appropriate plating finishing to provide electrical connection properties. In the illustrated embodiment both the ground metal plate 74 and the reinforcement metal plate 78 have a thickness of no greater than 0.20 mm. Other embodiments include different values or ranges of thicknesses.

Figure 11:
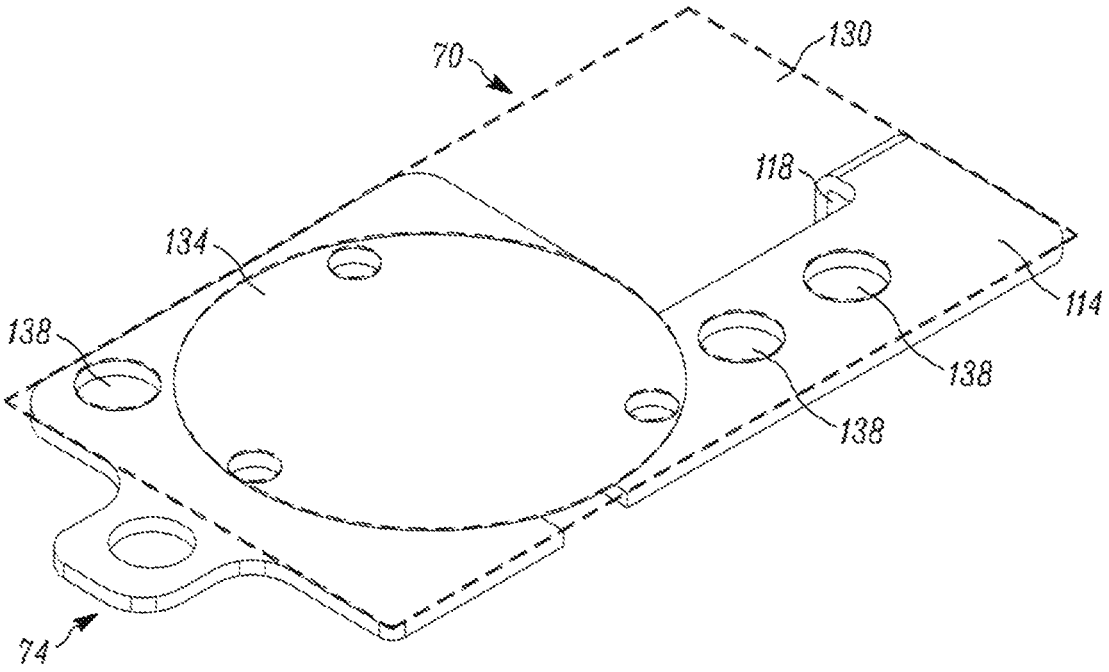
FIG. 11 is a perspective view of a dome array assembly of the push-to-talk assembly, coupled to the ground metal plate.

With reference to FIG. 11, the dome array assembly 70 is coupled to the ground metal plate 74. The dome array assembly 70 includes a third planar body portion 130, and a dome-shaped portion 134 that extends from the third planar body portion 130. The third planar body portion 130 is coupled directly to the first planar body portion 114 (for example with adhesive), such that the dome-shaped portion 134 extends away from the ground metal plate 74 in a first direction, and the first tab 118 extends away from the dome array assembly 70 in a second, opposite direction.

Figure 12:
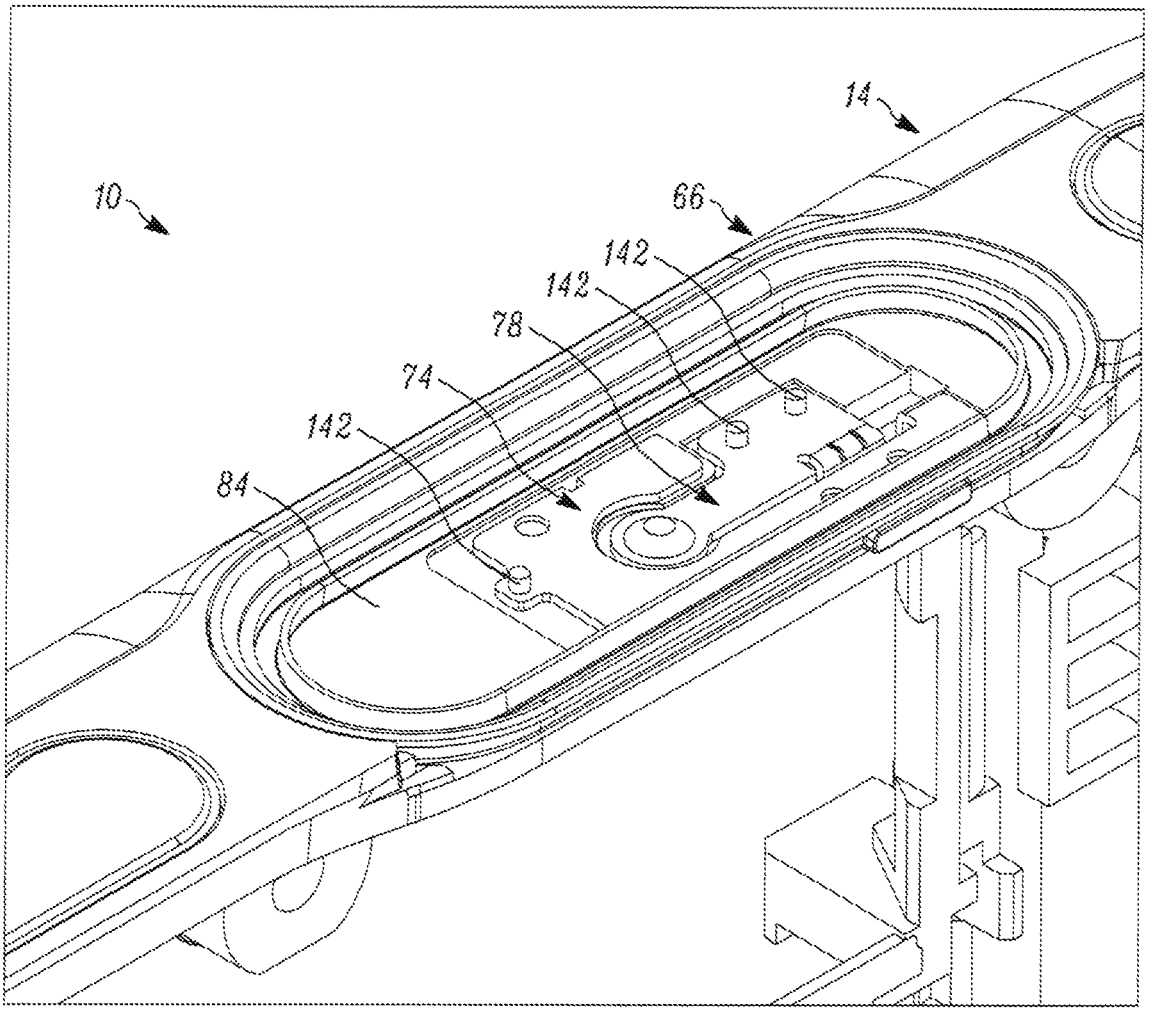
FIGS. 12 through 14 are perspective, partial views of the portable communication device of FIG. 1, illustrating portions of the push-to-talk assembly that have been coupled to a housing and a printed circuit board.

With reference to FIGS. 10 through 12, the ground metal plate 74, the reinforcement metal plate 78, and the dome array assembly 70 each include a plurality of apertures 138, at least one of which is used to receive a heat stake 142 (as seen in FIG. 12) on the housing 14. In some embodiments the heat stakes 142 are plastic, although other embodiments include different materials. To assemble the ground metal plate 74, the reinforcement metal plate 78, and the dome array assembly 70 to the housing 14, the apertures 138 on the ground metal plate 74 the dome array assembly 70 are aligned with one another and placed over one or more heat stakes 142, and the apertures 138 on the reinforcement metal plate 78 are placed over one or more heat stakes 142 (as seen in FIG. 12). The heat stakes 142 are then heated and allowed to cool, thereby rigidly fixing and mounting the ground metal plate 74, the reinforcement metal plate 78, the dome array assembly 70 in place. Other embodiments include different structures and methods by which to fix the ground metal plate 74, the reinforcement metal plate 78, and the dome array assembly 70 onto the portable communication device 10.

With reference to FIGS. 1 through 12, when a user presses on the first side 102 of the button 62, the second side 106 of the button 62 contacts the dome-shaped portion 134 and forces the dome-shaped portion 134 to flex relative to the first planar body portion 114 until the dome-shaped portion 134 contacts the free end 128 of the reinforcement metal plate 78. In the illustrated embodiment the dome-shaped portion 134, as well as the first planar body portion 114, are made of stainless steel, providing a tactile feedback to the user when the dome-shaped portion 134 is pressed. In some embodiments, the dome-shaped portion 134 includes electrical connection properties that are achieved by using plating finishing. Other embodiments of the dome-shaped portion 134 and the first planar body portion 114 are made of different materials.

Figure 13:
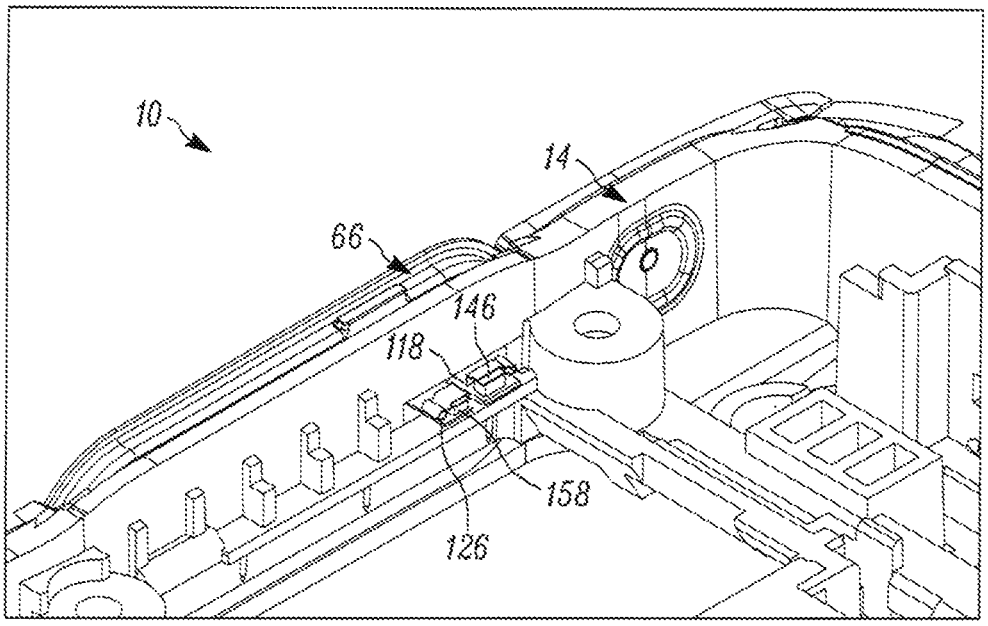
Figure 14:
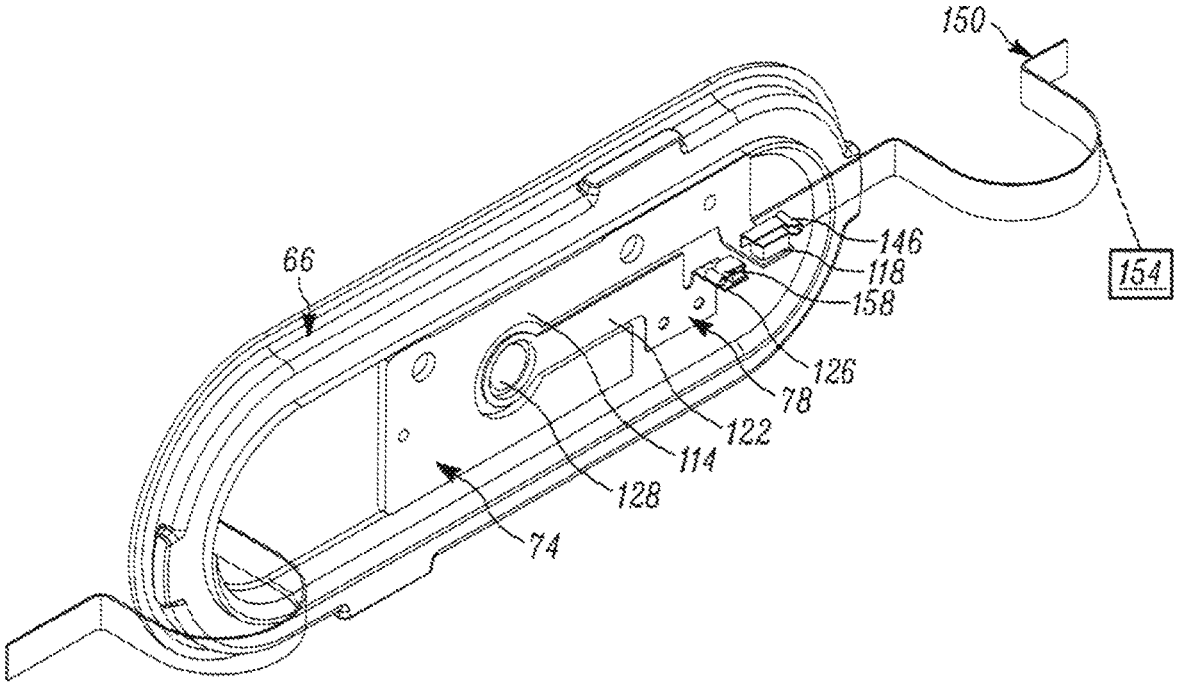
Figure 15:
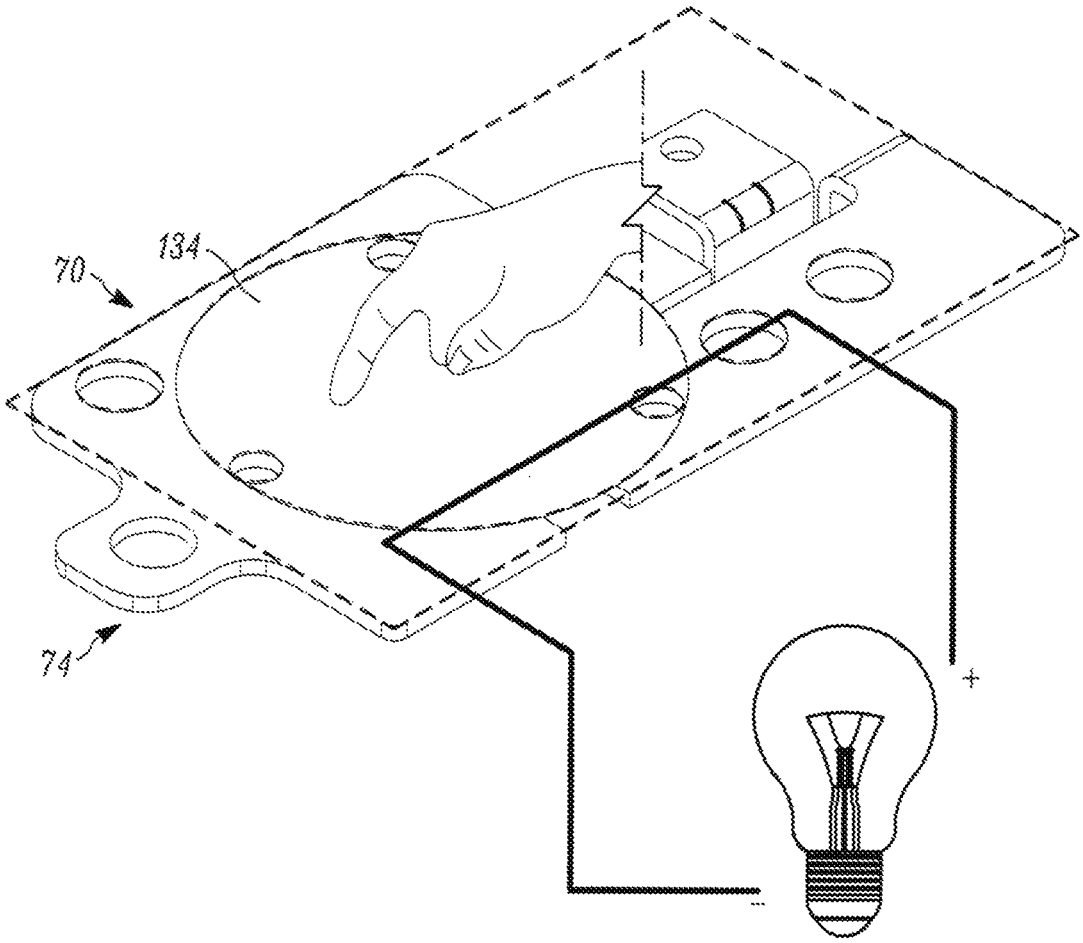
FIG. 15 is an illustration of a circuitry of the push-to-talk assembly.

With reference to FIGS. 13 through 15, the first tab 118 is coupled to a first electrical contact 146 (FIGS. 13 and 14) on a printed circuit board 150 (the boundaries of which are shown partially in FIG. 14). The first electrical contact 146 may be for example a spring contact, pogo pin, or other electrical contact. The printed circuit board 150 is positioned within the housing 14, and is coupled to an electrical processor 154 (shown schematically in FIG. 14). The second tab 126 is coupled to a second electrical contact 158 on the printed circuit board 150. The second electrical contact 158 may be for example a spring contact, pogo pin, or other electrical contact. In some embodiments, the ground metal plate 74 and/or the reinforcement metal plate 78 are alternatively etched by laser direct structuring onto a substrate of the housing 14, as opposed to being separate metal plates that are attached to the housing 14.

With continued reference to FIGS. 13 through 15, when the dome-shaped portion 134 contacts the free end 128, an electrical connection (FIG. 15) is completed between the first electrical contact 146, the first tab 118, the first planar body portion 114, the dome-shaped portion 134, the free end 128, the second planar body portion 122, the second tab 126, and the second electrical contact 158. In some embodiments this completed electrical connection causes the electrical processor 154 to activate a speaker or electrical component (not shown) within the portable communication device, thus allowing a user to speak to another portable communication device 10.

Figure 16:
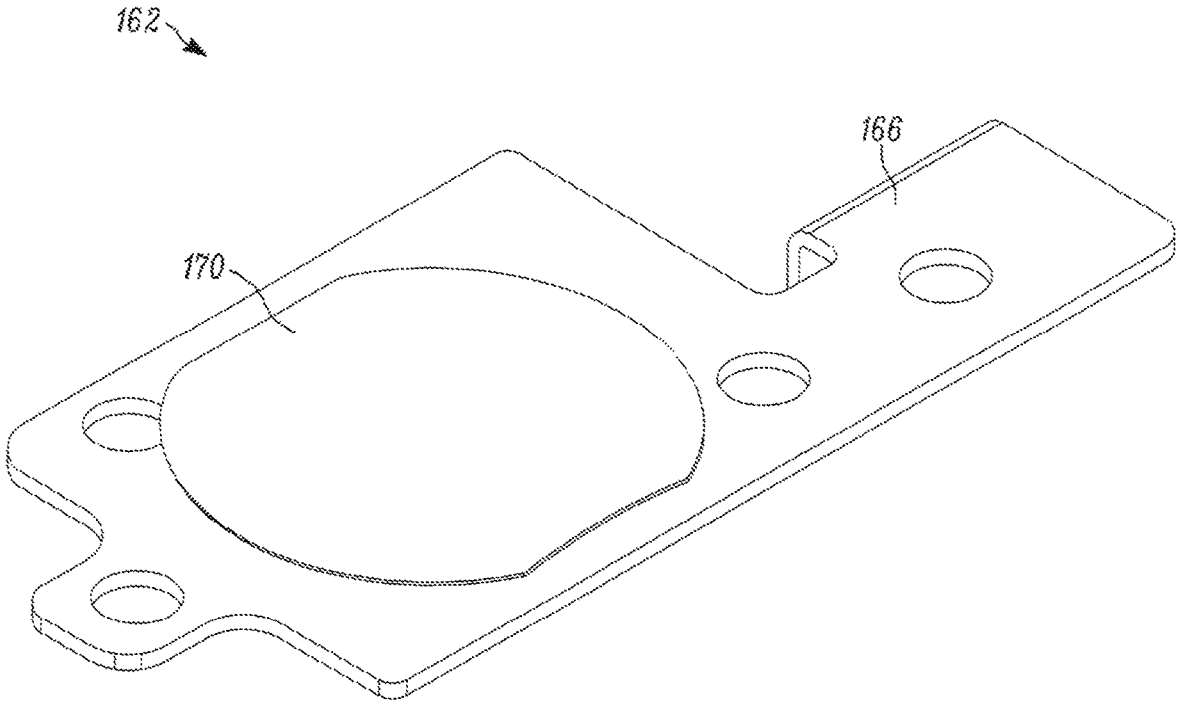
FIG. 16 is a perspective view of a dome array assembly according to another embodiment.

Use of the separate ground metal plate 74 and reinforcement metal plate 78 provides stability and backing strength during pressing of the button 62. In some embodiments, however, the portable communication device 10 includes a flexible printed circuit board (not shown) positioned within the housing 14, and does not use the separate ground metal plate 74 and reinforcement metal plate 78 described above. Rather, the flexible printed circuit board itself includes ground and life terminals (for example with gold or nickel plating) inside the flexible printed circuit board with a separation between the ground and life terminals. With reference to FIG. 16, in this embodiment, the portable communication device 10 uses a dome array assembly 162 in place of the ground metal plate 74 and the reinforcement metal plate 78. The dome array assembly 162 is configured to be coupled to the housing 14, and includes a first, planar portion 166 and a dome-shaped portion 170 (for example made of stainless steel sheet metal). When a user presses on the first side 102 of the button 62, the second side 106 of the button 62 contacts the dome-shaped portion 170, causing the dome-shaped portion 170 to flex and contact an electrical contact on the flexible printed circuit board, thus completing an electrical connection between the ground and life terminals.

Figure 17:
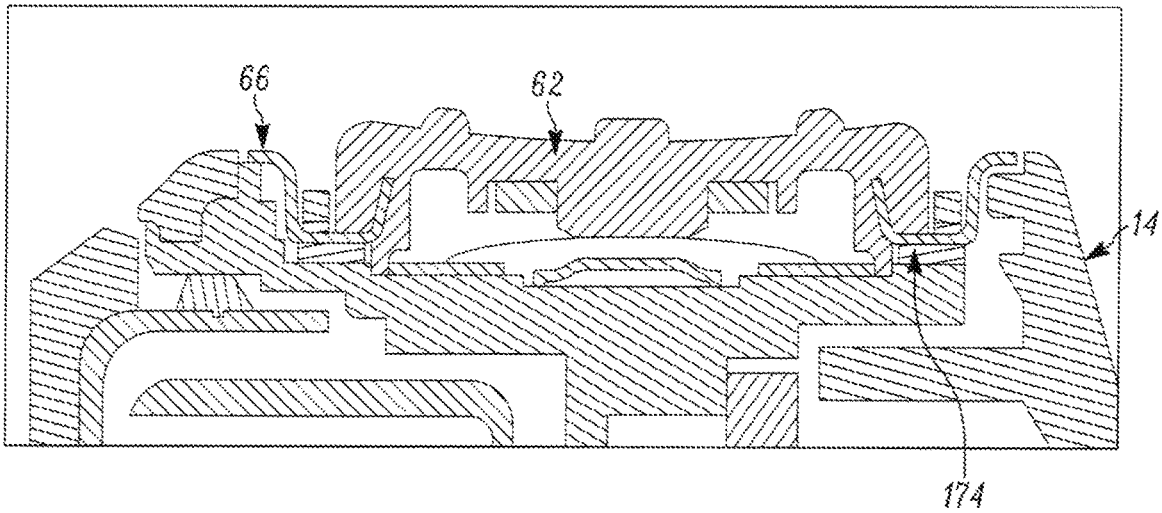
FIG. 17 is a cross-sectional view of the portable communication device of FIG. 1, taken along lines 17-17 in FIG. 3, illustrating an adhesive sealing element that seals the push-to-talk assembly to the housing.
Figure 18:
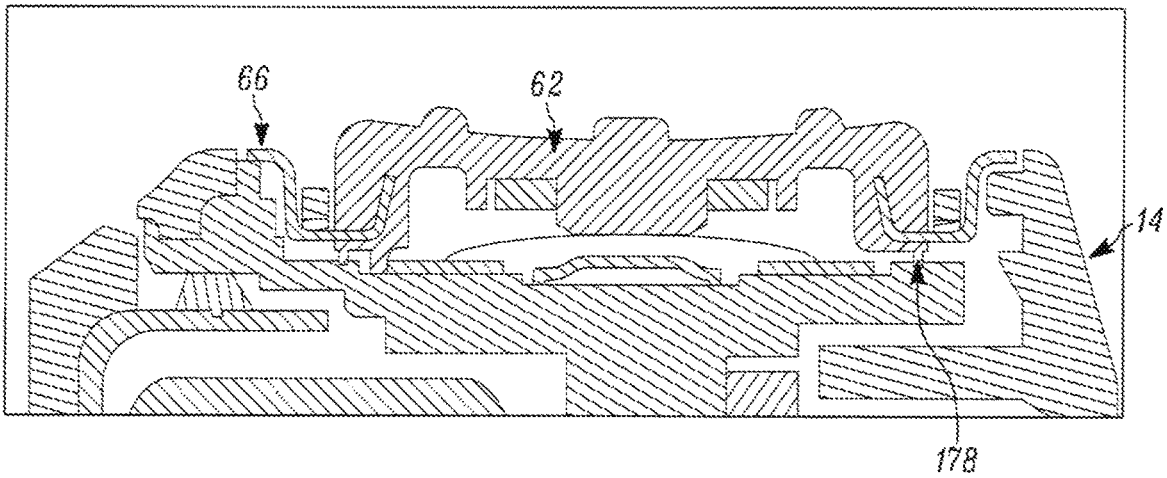
FIG. 18 is a cross-sectional view of a portable communication device according to another embodiment, illustrating a rubber sealing element that seals the push-to-talk assembly to the housing.

With reference to FIGS. 17 and 18, in some embodiments the push-to-talk assembly 58 is sealed to the housing 14 with a sealing element to inhibit or prevent the inflow of water or other materials into the portable communication device 10. For example, in some embodiments the sealing element is an adhesive 174 (for example pressure-sensitive adhesive or liquid adhesive) and is applied between the push-to-talk assembly 58 and the housing 14 (as seen in FIG. 17). In some embodiments the button 62 itself includes a sealing element in the form of at least one protrusion 178 (for example a rib made of silicone rubber) that extends from the button 624 and presses and forms a seal against the housing 14 when the push-to-talk assembly 58 is assembled onto the portable communication device 10 (as seen in FIG. 18). In some embodiments, the sealing element is molded together with the button 62. In some embodiments the sealing element is made of flexible, polymeric material. Other embodiments include different sealing elements and materials for the sealing elements, as well as different locations for the sealing elements than that illustrated in FIGS. 17 and 18.

With reference to FIG. 7, the push-to-talk assembly 58 has an overall thickness 182 (not including the first and second tabs 118, 126) measured along a direction that is perpendicular to the outer housing 14 along the side 46 of the portable communication device 10. In some embodiments the thickness 182 is less than 3 mm. In some embodiments, the thickness is less than 2.5 mm. In some embodiments, the thickness is between 2.0 mm and 2.5 mm. In some embodiments, the thickness is 2.1 mm. Other embodiments include different thicknesses and ranges of thicknesses.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a," "has . . . a," "includes . . . a," or "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

The invention claimed is:

1. A push-to-talk assembly for a portable communication device, the push-to-talk assembly comprising:

a metal ring defining an interior aperture and including at least one exterior protrusion configured to couple the metal ring to a surface of the portable communication device;

a button coupled to the metal ring and including a flexible polymer material disposed within the interior aperture and co-molded to the metal ring, the button including a first side configured to be contacted and pressed, and a second, opposite side configured to face an interior of the portable communication device;

a metal backing plate coupled to the second side of the button, and a reinforcement metal plate configured to be coupled to a printed circuit board within the portable communication device.

2. The push-to-talk assembly of claim 1, wherein the metal backing plate is at least one of adhesively bonded or co-molded to the second side of the button.

3. The push-to-talk assembly of claim 1, wherein the metal ring is an elongate ring having a ledge that extends inwardly toward the interior aperture, wherein the flexible polymer material is silicone rubber, and wherein a portion of the silicone rubber wraps around the ledge.

4. The push-to-talk assembly of claim 1, wherein the at least one exterior protrusion includes four protrusions that define undercuts to engage with a housing of the portable communication device.

5. The push-to-talk assembly of claim 1, wherein the flexible polymer material entirely fills the interior aperture.

6. The push-to-talk assembly of claim 1, further comprising a dome array assembly that is separately spaced from the backing plate, the dome array assembly having a planar body portion and a dome-shaped portion extending from the planar body portion, wherein the dome-shaped portion is configured to be contacted by the second side of the button and to flex relative to the planar body portion when the button is pressed.

7. The push-to-talk assembly of claim 6, wherein the dome array assembly is composed of stainless steel.

8. The push-to-talk assembly of claim 6, wherein the planar body portion of the dome array assembly includes a plurality of apertures configured to receive plastic heat stakes to mount the dome array assembly to the portable communication device.

9. The push-to-talk assembly of claim 6, further comprising a ground metal plate coupled to the dome array assembly, the ground metal plate having an extended tab configured to be coupled to the printed circuit board within the portable communication device.

10. The push-to-talk assembly of claim 9, wherein the ground metal plate is made of a titanium copper alloy, and has a thickness of no greater than 0.20 mm.

11. The push-to-talk assembly of claim 9, wherein the ground metal plate is adhesively bonded to the dome array assembly, wherein the planar body portion of the dome array assembly includes a first plurality of apertures, and wherein the ground metal plate includes a second plurality of apertures that are aligned with the first plurality of apertures, wherein the first plurality of apertures and the second plurality of apertures are configured to receive heat stakes to mount the dome array assembly and the ground metal plate to the portable communication device.

12. The push-to-talk assembly of claim 9, wherein a first portion of the reinforcement metal plate is configured to be coupled to the printed circuit board, and wherein the reinforcement metal plate includes a second, rigid portion that defines a stationary terminal with a hard contact area configured to be contacted by the dome-shaped portion of the dome array assembly.

13. The push-to-talk assembly of claim 12, wherein the reinforcement metal plate is made of a titanium copper alloy, and has a thickness of no greater than 0.20 mm.

14. A portable communication device comprising:

a housing;

a printed circuit board disposed within the housing; and a push-to-talk assembly coupled to the printed circuit board, the push-to-talk assembly further coupled to and disposed along a side of the housing, the push-to-talk assembly having a metal ring defining an interior aperture, the metal ring including at least one exterior protrusion that couples the metal ring to the housing, the push-to-talk assembly further including a button coupled to the metal ring, the button including a polymer material disposed within the interior aperture and co-molded to the metal ring, the button including a first side configured to be contacted and pressed, and a second, opposite side that faces an interior of the portable communication device;

wherein the push-to talk assembly additionally includes a ground metal plate having a first tab coupled to the printed circuit board, and a reinforcement metal plate having a second tab coupled to the printed circuit board.

15. The portable communication device of claim 14, wherein the button is substantially flush with the side of the housing.

16. The portable communication device of claim 14, wherein the push-to-talk assembly has an overall thickness of no more than 2.1 mm.

17. The portable communication device of claim 14, wherein the push-to-talk assembly is sealed to the housing with at least one of a pressure-sensitive adhesive, flexible polymer material, or a liquid adhesive.

18. The portable communication device of claim 14, wherein the button includes a region of collapsible rubber, and wherein when the push-to-talk assembly is coupled to the housing, the region of collapsible rubber seals the push-to-talk assembly to the housing.

19. The portable communication device of claim 14, wherein the push-to-talk assembly includes a metal backing plate adhesively bonded to the second side of the button.

20. The portable communication device of claim 14, wherein the push-to-talk assembly is sealed to the housing with an adhesive applied along an interior-facing surface of the metal ring.

21. The portable communication device of claim 14, wherein the push-to-talk assembly is sealed to the housing with a protrusion that extends from the second, opposite side of the button.

22. The portable communication device of claim 14, further comprising a dome array assembly, wherein the dome array assembly is separate from the printed circuit board.

23. The portable communication device of claim 14, wherein the push-to-talk assembly includes a dome array assembly coupled to the housing, the dome array assembly having a planar body portion and a dome-shaped portion extending from the planar body portion, wherein the dome-shaped portion is configured to be contacted by the bottom side of the button and to flex relative to the planar body portion.

24. The portable communication device of claim 23, wherein the ground metal plate is coupled to the dome array assembly, and wherein the reinforcement metal plate further includes a second, rigid portion that defines a stationary terminal with a hard contact area configured to be contacted by the dome-shaped portion of the dome array assembly.

* * * * *